United States Patent [19]

Vaudaux

[11] 4,079,961

[45] Mar. 21, 1978

[54] SELF RESTORING RELEASABLE SKI BINDING

[75] Inventor: Francis Vaudaux, Boege, France

[73] Assignee: The Garcia Corporation, Teaneck, N.J.

[21] Appl. No.: 737,036

[22] Filed: Oct. 29, 1976

[30] Foreign Application Priority Data

Nov. 3, 1975 France ..... 75 34538

[51] Int. Cl.[2] ..... A63C 9/08

[52] U.S. Cl. ..... 280/613; 280/618; 280/637

[58] Field of Search ..... 280/637, 618, 613

[56] References Cited

U.S. PATENT DOCUMENTS

| | | | |
|---|---|---|---|
| 3,893,682 | 7/1975 | Weinstein et al. | 280/637 |
| 3,924,866 | 12/1975 | Schweizer | 280/637 |
| 3,936,066 | 2/1976 | Witting | 280/637 |
| 4,026,576 | 5/1977 | Frechin | 280/637 |
| 4,026,577 | 5/1977 | Frechin | 280/637 |

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

In a releasable ski binding of the type wherein a sole-plate is operatively connected to the ski by means of at least one cable tensioned by a return mechanism within the sole-plate, a winding support having two diameters intersects one end of the cable within the sole-plate so that, on release, the section of cable extending from the return mechanism winds on the periphery of the area of the winding support of smaller diameter while the section of cable connected to the ski simultaneously unwinds from the periphery of area of the support having the larger diameter.

9 Claims, 5 Drawing Figures

FIG.3
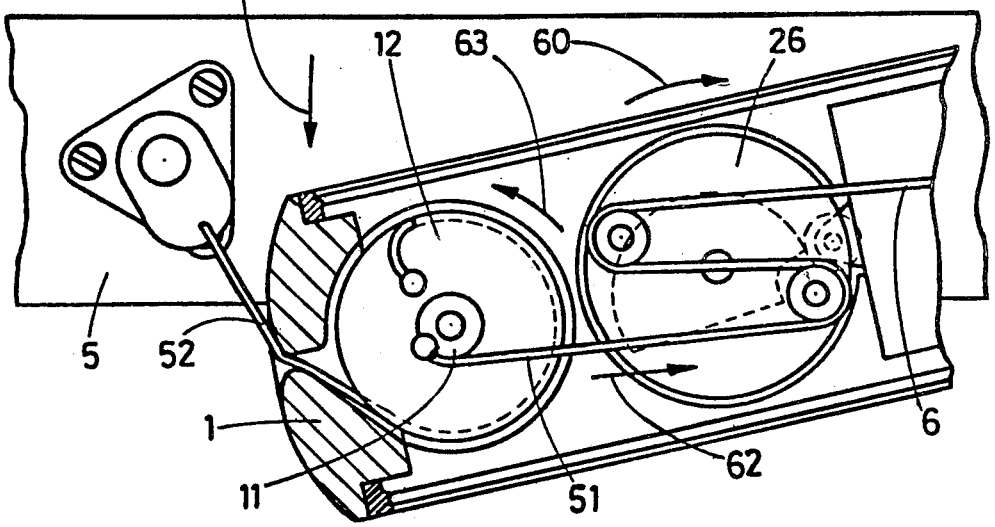
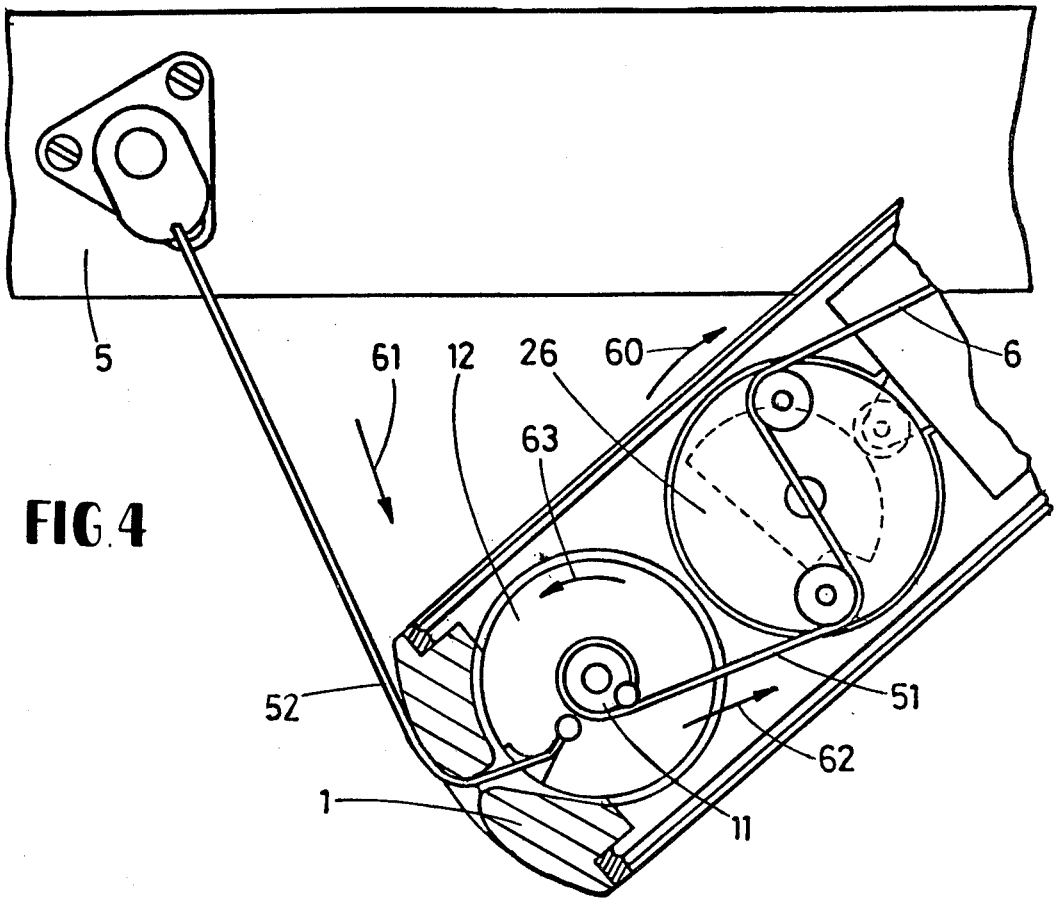
FIG.4

SELF RESTORING RELEASABLE SKI BINDING

BACKGROUND OF THE INVENTION

The present invention relates to safety ski bindings, and more specifically to ski bindings of the type having a sole-plate to which the sole of a ski boot is releasably secured. At least one end of the sole-plate is secured to the ski surface by a flexible cable which is placed under continuous tension thus urging the sole-plate toward the ski. Ski bindings of this type are often referred to as retractable bindings in that the sole-plate, after release, has a return capability to the skiing position. Typical is the binding described in U.S. Pat. No. 3,893,682.

In another binding of this general type, described in U.S. Pat. No. 3,924,866, each end of the sole-plate is connected to the ski by a cable. Each cable has one end connected to the ski and the other end to a system of levers or winders within a housing the function of which is to provide the holding tension between the boot and ski and to vary the holding effort of the binding during release. The elongation allowed each cable by this system during release is not great. Accordingly the amount of displacement between the boot and ski is also not great which can lead to injury.

The safety ski binding according to the invention remedies the above-mentioned disadvantage by permitting, on release, a relatively considerable elongation of the cable, which, for example, can be equal to three or four times the elongation that would be permitted by a spring return device alone. This permits the sole-plate and ski boot to separate from the ski a sufficient distance to minimize the possibility of injury causing contact. At the same time, a predetermined ratio is maintained between the release effort and the tension of the spring return device.

Moreover, the present invention comprises a further improvement over known bindings by attaining the aforementioned cable elongation utilizing only one cable tensioning or return mechanism. This reduces the possibility of mechanical failure in such bindings and also achieves a desirable reduction in weight.

SUMMARY OF THE INVENTION

The ski binding of the present invention comprises a sole-plate secured at opposite extremities to a ski by at least one flexible cable. The cable is tensioned by a spring loaded return device housed within the plate to continuously urge the sole-plate towards the ski surface. Within the sole-plate, one end of the cable is intersected between the return device and the ski by a winding support having at least two integral concentric members of different diameters. The free end of the part of the cable connected to the return device is connected to the periphery of the support of smaller diameter; and the free end of the part of the cable connected to the ski is connected to the periphery of the support of larger diameter, around which periphery it is wound by at least a fraction of a turn when the binding is in the closed or skiing position. The ends of the cables are each connected to the respective supports so that, on release of the fastening, the cable is wound on the periphery of the support of smaller diameter and is simultaneously unwound from the support of larger diameter.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIGS. 3 and 4 represent, in plan view, partially sectioned along lines II—II of FIG. 1, the same embodiment, in two different positions during transverse release.

DESCRIPTION OF THE INVENTION

Figure 1:
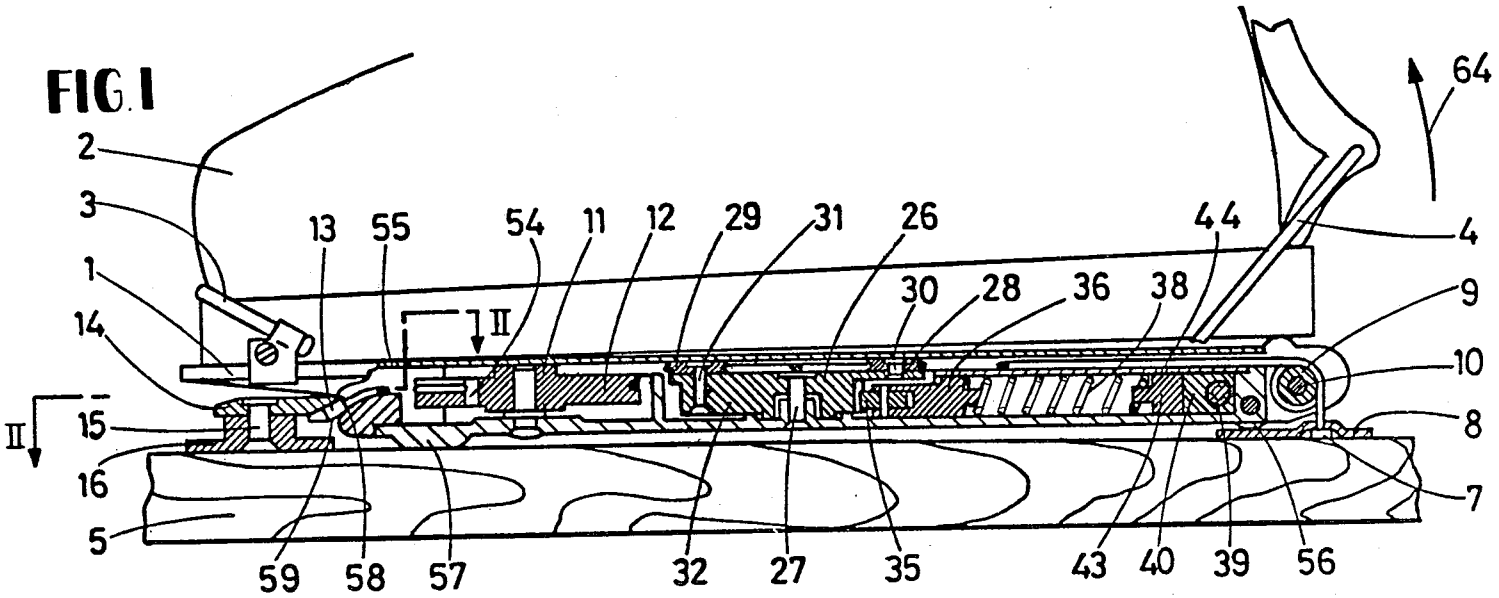
FIG. 1 is a longitudinal cross-section view of a binding of the invention in skiing position, the cross-section being taken along lines I—I of FIG. 2.
Figure 2:
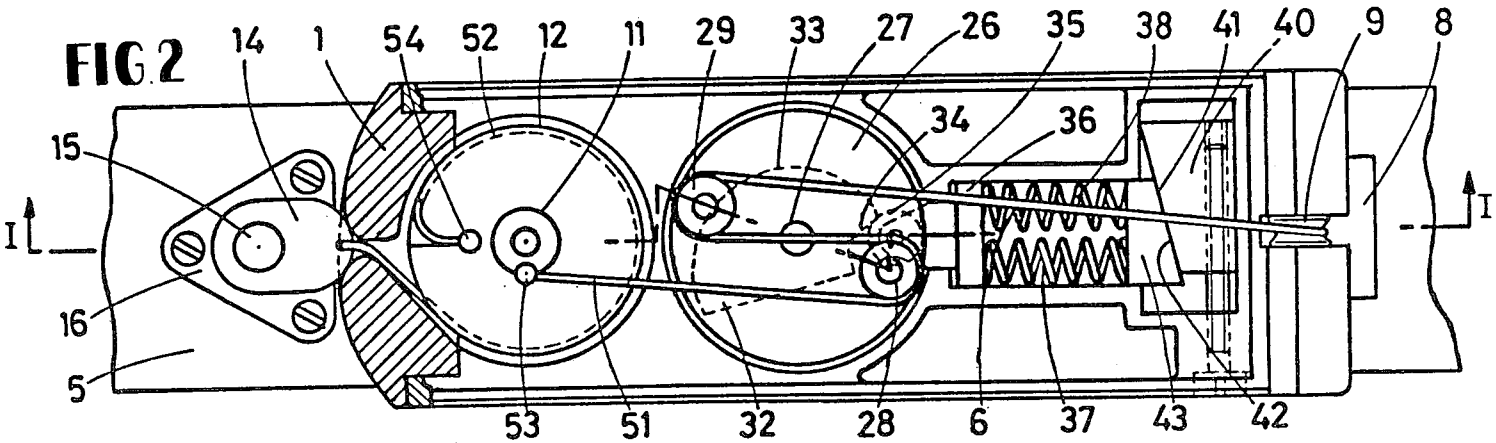
FIG. 2 is a plan view, partially sectioned along lines II—II of FIG. 1.

As shown in FIGS. 1 and 2, the ski binding of the invention comprises a sole-plate 1 having a front holding element 3 and a back holding element 4 for releasably securing the sole of ski boot 2 to the top surface thereof. Each end of plate 1 is connected to the ski 5 by a cable generally indicated by the numeral 6 which is continuously tensioned by a spring loaded return device. The rear end 7 of cable 6 is fastened to ski 5 by a fastening plate 8. The cable 6 then passes over a pulley 9 mounted on a horizontal shaft 10 located at the rear of sole-plate 1, is mechanically connected to the spring return device and then to the winding support having two diameters 11 and 12. Finally, the front end of cable 6, which is equipped with a stop element 13, is secured to a pivot head 14 supported by ski 5 by means of a shaft 15 set vertically in relation to the upper face of ski 5 and in the longitudinal axis of the latter. Shaft 15 is secured to the ski by a fastening plate 16. Reference is made to commonly owned U.S. patent application Ser. No. 680,859 filed Apr. 27, 1976 as illustrating a particularly suitable front connection for cable 6 in more detail.

The spring loaded return device comprises a support 26 mounted to rotate around a shaft 27 set vertically within sole-plate 1. Two pulleys 28 and 29 are rotatably mounted on support 26 by shafts 30 and 31 respectively. The pulleys 28 and 29 are mounted in diametrically opposite positions and in substantially the same plane. Support 26 further includes a cam element 32, having a V-notch 34 and a radial surface 33. The cam element 32 is arranged so that the radial surface 33 increases as support 26 passes from a rest or skiing position (FIGS. 1 and 2) to a release position (FIG. 4), in which sole-plate 1 is, for example, transversely separate from ski 5. Cam element 32 is continuously in contact with a roller 35 pivoted on a push rod 36 subjected to the permanent action of two compression springs 37 and 38. The tension of springs 37 and 38 is adjustable by means of a transverse screw 39, the rotation of which axially displaces a block 40 having an inclined face 41 cooperating with an inclined face 42, of corresponding profile, provided on a bearing 43 movable perpendicularly to block 40 and serving as a fixed bearing for the springs 37 and 38. Thus, by rotating screw 39, the position of block 40 may be transversely adjusted thus altering the compression of springs 37 and 38 via bearing 43. A cover 44 is provided over the springs and their regulating device to insure against any interference with the movement of cable 6.

Those skilled in the art will appreciate that a single compression spring may be used for loading the return mechanism. Similarly, it should be understood that more than two compression springs, for example five, may be utilized, the only limitation being the dimensions of the springs and sole-plate. It should also be understood that different spring arrangements may be utilized to load the return mechanism. In this regard, suitable loading arrangements are disclosed in co-pending commonly owned U.S. application Ser. No. 584,403, filed June 6, 1975 and now U.S. Pat. No. 4,026,527 issued May 31, 1977. The manner of adjusting the tension of the compression springs may also be varied in accordance with the present invention. For example, instead of using complementary transverse blocks 40 and 43, set screws may be mounted longitudinally from the rear of the sole-plate 1 to directly adjust the position of bearing 43 and the axial pressure on the springs.

Cable 6 is mechanically connected to the spring return device by means of pulleys 28 and 29, on which it is at least partially wound in an "S" configuration as shown in FIG. 2. Between the spring return device and the front of sole-plate 1, cable 6 is intersected to present two sections 51 and 52, the free ends of which, 53 and 54 respectively, are connected to the two diameters 11 and 12 of the winding support. As stated above, the winding support comprises two integral, concentric members mounted for rotation about a common vertical shaft. Preferably, the winding support is manufactured as a unitary piece having two diameters. Member 12 has a diameter which is, for example, three times greater than that of member 11.

The end 53 of section 51 connected to the spring return device is connected to the periphery of member 11. The point of connection is, for example, set up so that when the binding is in the closed or skiing position (FIG. 2), section 51 is arranged in a tangent to the periphery of member 11. The end 54 of section 52 is connected to the periphery of member 12, on which periphery it is, for example, wound approximately one turn when the binding is in closed or skiing position (FIG. 2). Ends 53 and 54 are each connected to the respective support so that on release of the binding, section 51 is wound on the periphery of member 11 and section 52 is simultaneously unwound from member 12.

As described herein, the flexible cable element of the invention is characterized as a single cable which is intersected by the winding support members 11 and 12 to present two sections 51 and 52. The cable is so described since both the front and rear connections to the ski are tensioned via the same cable in association with a single return mechanism. This is opposed to arrangements wherein two separate cables are tensioned independently by different spring loaded return mechanisms. Accordingly it is to be understood that the term "single cable," as used herein, is intended to describe the two cables, as illustrated, which are operatively connected by the winding support.

A cover 55 to sole-plate 1 closes the housing in which is set the spring return device and the two winding members 11 and 12. The back part of sole-plate 1 carries rollers 56 which bear on plate 8 when the binding is in closed position. In the same position, sole-plate 1 includes, under its front part, a bearing 57 which bears on the surface of ski 5. A profiled front end 58 of sole-plate 1 is then engaged with a corresponding profiled part 59 of pivot head 14.

When the binding is in the closed or skiing position, the different elements occupy the positions represented in FIG. 2. In such condition, cable 6 is wound to the maximum on pulleys 28, 29 which are then positioned almost on the longitudinal axis of ski 5; and sole-plate 1 is securely seated on ski 5 by the traction exerted by cable 6. The traction or holding effort exerted by cable 6 is in a constant state due to the interaction of roller 35 and notch 34 on the cam element 33.

When the boot 2 exerts an effort tending to separate sole-plate 1 from that rest position, such as during a fall, roller 35 initially opposes the rotation of support 26 and the paying out of cable 6, which would enable plate 1 to separate from ski 5. If the effort exerted by the boot should exceed a predetermined value, roller 35 runs over the face of V-notch 34 against the action of springs 37 and 38 and support 26 first rotates slightly in the direction of arrow 60 to occupy roughly the angular position represented in FIG. 3. In that condition, section 51 of cable 6 is wound partially on winding member 11 and section 52 is partially unwound from winding member 12.

If the effort exerted by boot 2 continues, the different elements occupy, for example, the position represented in FIG. 4. In such condition, section 51 of cable 6 is wound approximately one turn around winding member 11, the length of which corresponds to the length of cable released by the spring return device which has rotated about a quarter of a turn. At the same time, section 52 of cable 6 is fully unwound from winding member 12, thus giving maximum separation between the front of sole-plate 1 and ski 5. Since the diameters of winding member 11 and 12 are, in this example, chosen respectively in a ratio of one to three, when the spring return device pays out, for instance, a length of one centimeter of cable 6, winding support 12 pays out a length of three centimeters of same. Elongation of cable 6 is thus made possible in a relatively large ratio. It is also to be noted that, winding member 11 and 12 have in no way modified the holding effort exerted by the spring return device.

In the condition of FIG. 4, section 52 of cable 6 has been fully unwound from member 12 thus giving maximum separation between ski 5 and the front of sole-plate 1. In the condition of maximum separation at the front of the sole-plate 1 the support 26 of the spring return device has rotated approximately one quarter of a turn. Thus, it will be evident to those skilled in the art, that support 26 may rotate a further quarter of a turn to pay out cable 6 from the rear of sole-plate 1 thus also permitting simultaneous separation of the rear of sole-plate 1 from ski 5.

When the transverse forces exerted by the boot 2 cease, the spring return device exerts a retraction effort in direction 62 on section 51 of cable 6, which causes winding member 11 to rotate in direction 63. Section 52 of cable 6 is thus rewound on member 12 and all of the elements resume the position represented on FIGS. 1 and 2.

If the release effort is exerted from bottom to top in the direction of arrow 64 (FIG. 1) by the back part of the boot, such as when the skier falls forward, the spring return device alone pays out cable 6 from the rear of sole-plate 1. In such instance, the tension exerted on section 51 of cable 6 tends to bring the front part of sole-plate 1 into bearing on the ski and to keep it thus in bearing. It is to be noted that the release effort, on a twisting fall (FIGS. 3 and 4), is three times less than the release effort in a forward fall. This ratio between the release efforts is equal to the ratio existing respectively between the diameter of winding member 11 and that of winding member 12. The fact that such a ratio is obtained between the release efforts is particularly important, for it makes it possible to use a single spring return device, exerting a single tension on cable 6 while still attaining two release values.

Figure 5:
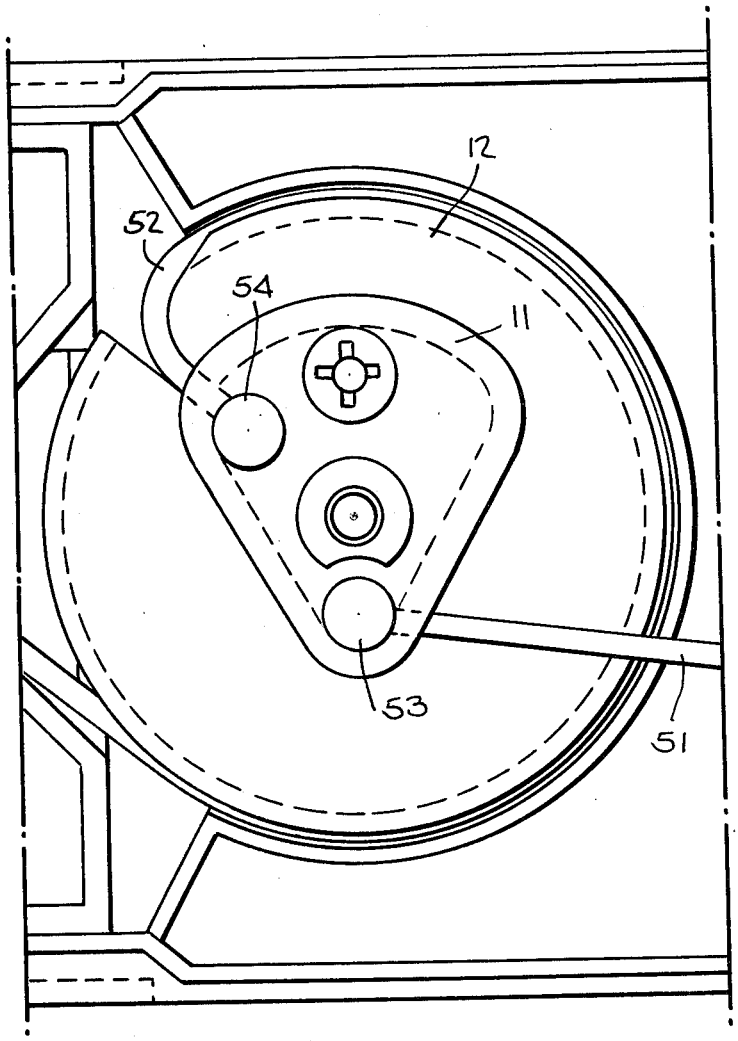
FIG. 5 is a plan view of a modified form of the winding support of the invention.

As described hereinabove, the winding members 11 and 12 have a substantially uniform circular diameter. In another, particularly suitable configuration, as illustrated in FIG. 5, the lower winding support 12, having the greater diameter, is, again substantially circular. However, the winding member 11, of lesser diameter, is of a non-circular configuration such as a segment of a circle with cable section 51 connected at 52 to the apex of the segment. Moreover, as shown in FIG. 5, the connection 54 for cable section 52 may be positioned slightly off the longitudinal axis of the plate 1. This particular arrangement achieves a different release characteristic. Specifically the non-circular configuration of winding member 11 creates an initial tension which must be overcome for release of the front of sole-plate 1 as cable 51 is wound on such member and then an increased tension as the cable approaches and engages the arcuate section of member 11. Such increased tension is desirable to initiate return of the sole-plate to the skiing position after abatement of release forces as well as to prevent sharp impact upon full extension of the cable. Thus, it will be readily appreciated that, by altering the configuration as well as the diameter of members 11 and 12, the release and return characteristics of the binding of the invention may be readily changed.

What is claimed is:

1. In a releasable ski binding comprising a sole-plate, clamping means mounted to said sole-plate for securing the sole of a ski boot thereon, at least one flexible cable having one end adapted to be secured to the surface of a ski and the other end associated with a spring loaded return means housed within said sole-plate, said cable and spring loaded return means being constructed and arranged to continuously urge said sole-plate into engagement with said ski and to permit separation thereof upon application of predetermined force, the improvement which comprises:

a winding support rotatably mounted within said sole-plate, said winding support having two integral concentric members of different diameters, said cable being sectioned by said winding support between said spring loaded return means and said ski; means mounting the end of said cable section extending from said spring loaded return means to the periphery of the member of smaller diameter; and means mounting the end of said cable section leading to said ski to the periphery of the member of larger diameter, said cable sections being mounted to said winding support whereby, upon release of said binding said one cable section winds upon the periphery of smaller diameter while said other cable section simultaneously unwinds from the periphery of larger diameter to provide greater separation between said plate and said ski.

2. The ski binding of claim 1, wherein the peripheries of both of said concentric members are circular.

3. The ski binding of claim 1, wherein the periphery of said member of larger diameter is circular and the periphery of said member of smaller diameter is non-circular.

4. A ski binding having release and return capabilities comprising:

a sole plate;

means mounted to said sole-plate for releasably securing the sole of a ski boot thereon;

at least one flexible cable extending from the ends of said sole-plate and including means for attaching the ends of said cable to the surface of a ski;

a return mechanism housed within said sole-plate, said return mechanism including a rotatable support having a pair of pulleys diametrically mounted thereon in substantially the same plane, a cam section, and biasing means constructed and arranged to engage said cam section, said support being rotatable between a first position in which said cable is wound about said pulleys to hold said sole-plate to said ski and a second position in which said cable is unwound from said pulleys to allow separation of said sole-plate and ski, the radius of said cam section increasing from said first to said second positions; and a winding support rotatably mounted within said sole-plate, said winding support having two integral concentric members of different diameters, said cable being sectioned between said return mechanism and one end of said sole-plate; means mounting the end of said cable section extending from said return mechanism to the periphery of the member of smaller diameter; and means mounting the end of said cable section leading to said ski to the periphery of the member of larger diameter, said cable sections being mounted to said winding support whereby, as said return mechanism rotates from said first to said second position said one cable section winds upon the periphery of small diameter while said other cable section simultaneously unwinds from the periphery of larger diameter to provide greater separation between said plate and said ski.

5. The ski binding of claim 4, wherein the peripheries of both of said concentric members are circular.

6. The ski binding of claim 4, wherein the periphery of said member of larger diameter is circular and the periphery of said member of smaller diameter is non-circular.

7. The ski binding of claim 4, wherein said biasing means comprises a plurality of compression springs axially arranged within said sole-plate, said springs bearing upon a push rod to which a roller is mounted, said roller being arranged to engage said cam section so that, as said support rotates from said first to said second position, said cam compresses said springs.

8. The ski binding of claim 7, wherein said biasing means further includes means for adjusting the axial pressure of said springs.

9. A ski binding having release and return capabilities comprising:

a sole plate;

toe and heel clamping members mounted to said sole-plate for releasably securing the sole of a ski boot thereon;

at least one flexible cable extending from the ends of said sole-plate and including means for attaching the ends of said cable to the surface of a ski;

a return mechanism housed within said sole-plate for placing a continuous tension on said cable, said return mechanism including a rotatable support having a pair of pulleys diametrically mounted thereon in substantially the same plane, said support being rotatable between a first position in which said cable is wound about said pulleys to hold said sole-plate to said ski and a second position in which said cable is unwound from said pulleys to allow separation of said sole-plate from said ski;

a cam integral with said rotatable support and having an increasing radius;

a plurality of compression springs axially positioned within said sole-plate bearing upon a push bar to which is mounted a roller, said roller being constructed and arranged to engage the radius of said cam whereby said springs are compressed as said support rotates from said first to said second position; and a winding support rotatably mounted within said sole-plate, said winding support having two integral concentric members of different diameters, one of said members having a circular periphery of larger diameter and the other of said members having a non-circular periphery of smaller diameter, said cable being sectioned between said return mechanism and one end of said sole-plate; means mounting the end of said cable section extending from said return mechanism to the periphery of the member of smaller diameter; and means mounting the end of said cable section leading to said ski to the periphery of the member of larger diameter, said cable sections being mounted to said winding support whereby, as said return mechanism rotates from said first to said second position said one cable section winds upon the periphery of smaller diameter while said other cable section simultaneously unwinds from the periphery of larger diameter to provide greater separation between said plate and said ski.

* * * * *